United States Patent [19]

Nishijima et al.

[11] Patent Number: 4,881,102

[45] Date of Patent: Nov. 14, 1989

[54] COPIER WITH VARIABLE MAGNIFICATION RATIO

[75] Inventors: Masaru Nishijima; Akihiro Soga, both of Nara, Japan

[73] Assignee: Sharp Kabushiki Kaisha, Osaka, Japan

[21] Appl. No.: 252,680

[22] Filed: Oct. 3, 1988

[30] Foreign Application Priority Data

Oct. 21, 1987 [JP] Japan ..... 62-266714

[51] Int. Cl.[4] ..... G03G 15/00

[52] U.S. Cl. ..... 355/243; 355/235; 355/56

[58] Field of Search ..... 355/243, 233, 235, 55, 355/56, 57, 60, 218

[56] References Cited

U.S. PATENT DOCUMENTS

| | | | |
|---|---|---|---|
| 4,222,660 | 9/1980 | Furuichi et al. | 355/55 X |
| 4,323,308 | 4/1982 | Kitajima et al. | 355/243 X |
| 4,441,805 | 4/1984 | Smith | 355/243 |
| 4,494,866 | 1/1985 | Rattin et al. | 355/57 |
| 4,552,450 | 11/1985 | Tomosada et al. | 355/243 |
| 4,568,173 | 2/1986 | Abuyama | 355/243 |
| 4,579,445 | 4/1986 | Hasegawa | 355/243 |
| 4,624,552 | 11/1986 | Asako | 355/55 |
| 4,743,944 | 5/1988 | Tomosada et al. | 355/218 |
| 4,752,809 | 6/1988 | Ito | 355/218 |

*Primary Examiner*—A. C. Prescott

*Attorney, Agent, or Firm*—Flehr, Hohbach, Test, Albritton & Herbert

[57] ABSTRACT

A copier capable of varying magnification ratio moves its optical system to a position determined by an inputted value of magnification ratio only after its print switch is operated to start a copying operation.

3 Claims, 3 Drawing Sheets

FIG,-1

COPIER WITH VARIABLE MAGNIFICATION RATIO

BACKGROUND OF THE INVENTION

This invention relates to an improvement in a copier capable of varying its image magnification ratio by moving an optical system such as a lens.

An electrophotographic copier is provided with an optical system including a light source, mirrors and a lens to focus a beam of light reflected from an original document to be copied on a photosensitive body to form thereon a latent image. The magnification of the image thus formed by an optical system on the photosensitive body is usually 100% with respect to the original document but the image magnification can be varied by moving the optical system. With a conventional copier, copying with a different magnification ratio is usually effected by key-inputting a desired magnification ratio so as to cause the optical system to move according to the inputted ratio and thereafter operating a print switch to make a copy at the desired magnification ratio. If the user of a conventional copier thus structured changes the setting several times before finally operating the print switch, however, the optical system is moved to a new position as many times and this causes the optical system to wear out quickly.

Some copiers are provided with an auto-clear function such that most frequently used magnification ratio and concentration are set as a default mode and if a preset length of time passes without any key-input, the default mode of operation is automatically set. If the user of such a copier enters a desired magnification ratio and leaves the area momentarily, however, the optical system which has once moved to the position corresponding to the desired magnification ratio returns to its original position corresponding to its default mode. This means that the desired magnification ratio must be inputted again and the optical system must accordingly be moved again. To cause the optical system to make many useless trips is also to waste the operation time.

SUMMARY OF THE INVENTION

It is therefore an object of the present invention in view of the above to provide a copier capable of varying its magnification ratio which does not cause its optical system to travel uselessly many times such that its optical system does not wear out quickly.

The above and other objects of the present invention can be achieved by providing a new kind of copier capable of varying its magnification ratio characterized as moving its optical system only after its print switch is operated to start its copying operation such that wasteful movements of the optical system can be prevented. A copier embodying the present invention with which these objects can be achieved comprises not only an input means for inputting a desired image magnification ratio and a lens moving means for moving its optical system according to the inputted magnification ratio but also a control means for activating this lens moving means to move the optical system according to the inputted magnification ratio only after the print switch for starting its copying operation is operated.

With a copier thus structured, the optical system including a lens does not move to a new position immediately after a magnification ratio is inputted. Instead, the optical system moves to the new position according to the desired magnification ratio only after the print switch is operated to start the copying operation. In other words, the user may change his or her mind and set a new magnification ratio any number of times without causing the optical system to move to a new position each time a new ratio is inputted through its input device.

BRIEF DESCRIPTION OF THE DRAWINGS

The accompanying drawings, which are incorporated in an form a part of the specification, illustrate an embodiment of the present invention and, together with the description, serve to explain the principles of the invention. In the drawings.

DETAILED DESCRIPTION OF THE INVENTION

Figure 1:
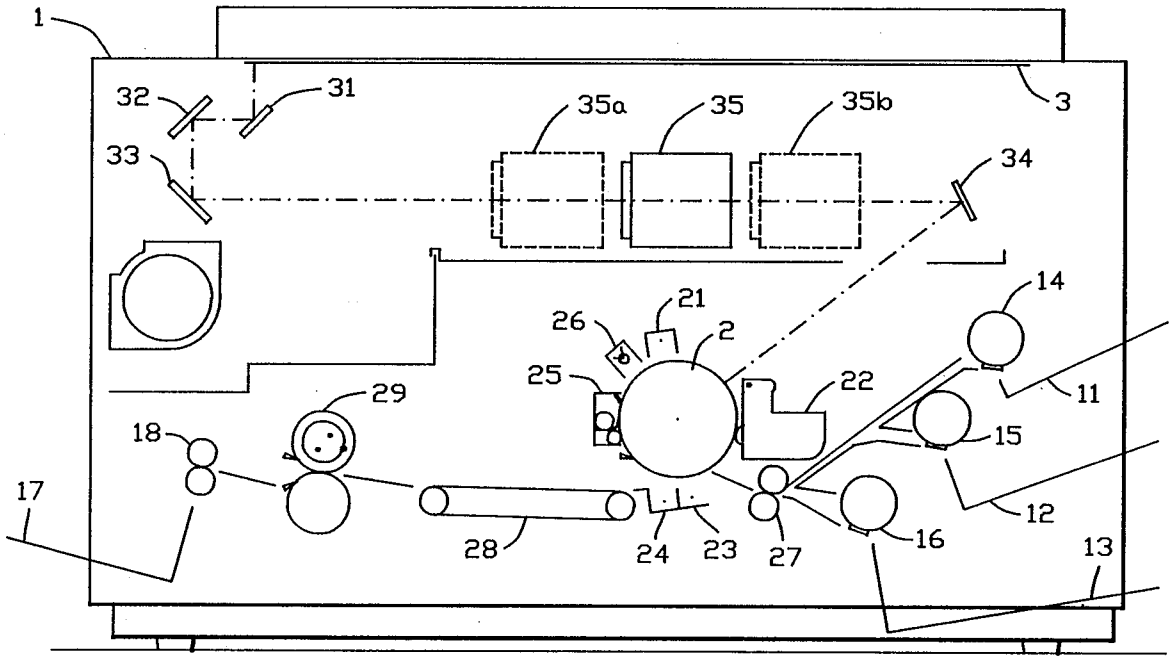
FIG. 1 is a schematic frontal sectional view of a copier embodying the present invention.

With reference to FIG. 1 which schematically shows the structure of a copier embodying the present invention, numeral 2 indicates a photosensitive drum disposed approximately at the center of a copier housing 1, surrounded by a primary charger 21, a developing device 22, an image transfer charger 23, a sheet removing charger 24, a cleaning device 25 and a charge removing lamp 26 which, together with the photosensitive drum 2, form the copy processing section of the copier. The right-hand side of the housing 1 contains paper cassettes 11, 12 and 13 and paper feeder rollers 14, 15 and 16 which together form the paper supplying section. The left-hand side of the housing 1 contains a paper discharge tray 17 and a paper discharge roller 18 which together form the paper discharge section. Timing rollers 27, a conveyor belt 28 and fixing rollers 29 are disposed between the paper feeding section and the paper discharge section and form a paper transportation section through the copy processing section.

A document table 3 is formed on the upper surface of the housing 1. Below the document table 3 is an optical system including a light source (not shown), mirrors 31–34 and a zoom lens 35 for scanning a document placed on the document table 3 to focus the reflected light therefrom on the photosensitive drum 2. The zoom lens 35 can be moved by a motor (not shown) to positions shown by broken lines at **35*a* and 35*b* to thereby form an enlarged or reduced image on the photosensitive drum 2**.

Figure 2:
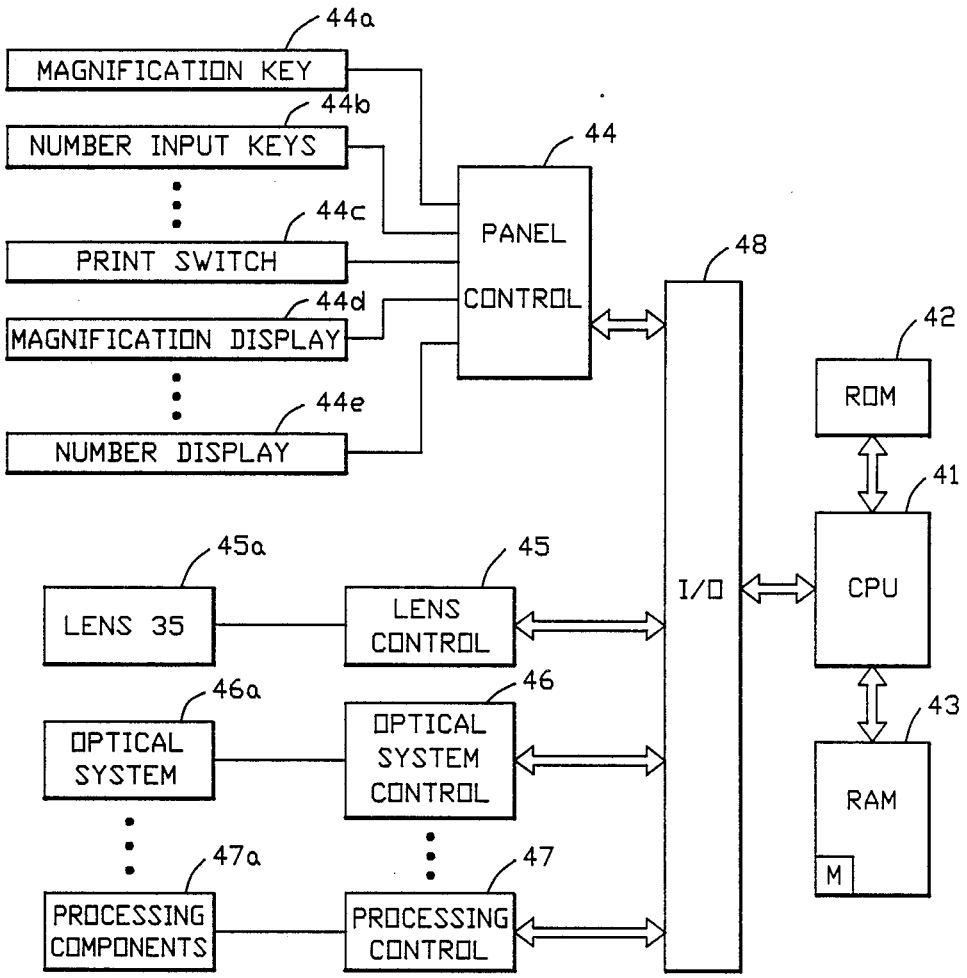
FIG. 2 is a block diagram of the copier of FIG. 1.

With reference next to FIG. 2 which is a block diagram of the control unit of the copier shown in FIG. 1, numeral 41 indicates a central processing unit CPU 41 which controls the overall operation of the e copier, its processing program being preliminarily stored in a read-only memory ROM 42. A random-access memory RAM 43 is used as a working area for the execution of the program. Although not shown in FIG. 1, a control panel is disposed on the upper surface of the housing 1. The control panel is provided with many input keys and switches, including a magnification key **44*a* for inputting a desired image magnification ratio, copy number input keys 44*b* for specifying a desired number of copies to be produced and a print switch 44*c* for starting the printing operation as well as display sections such as a magnification display 44*d* for displaying the inputted magnification ratio and a copy number display 44*e* for displaying the inputted number of copies. These input keys and display sections are controlled by a panel control section 44 and input data such as the desired magnification ratio and the desired number of copies as well as a print start signal are communicated to the CPU 41 through an input-output interface circuit 48 and/or displayed at the display sections. The desired magnification ratio inputted through the magnification key 44***a* is stored at a memory area indicated by M. The zoom lens 35 is controlled by a lens control section 45 and is adapted to move the lens 35 to a position such that a copy image with the specified magnification can be formed on the photosensitive drum 2. The CPU 41 is adapted to exchange data through the interface circuit 48 not only with the lens control section 45 but also with an optical system control 46 for controlling the light source and the mirrors of the optical system 46*a* and a process control section 47 for controlling the various components of the copy processing section.

Figure 3:
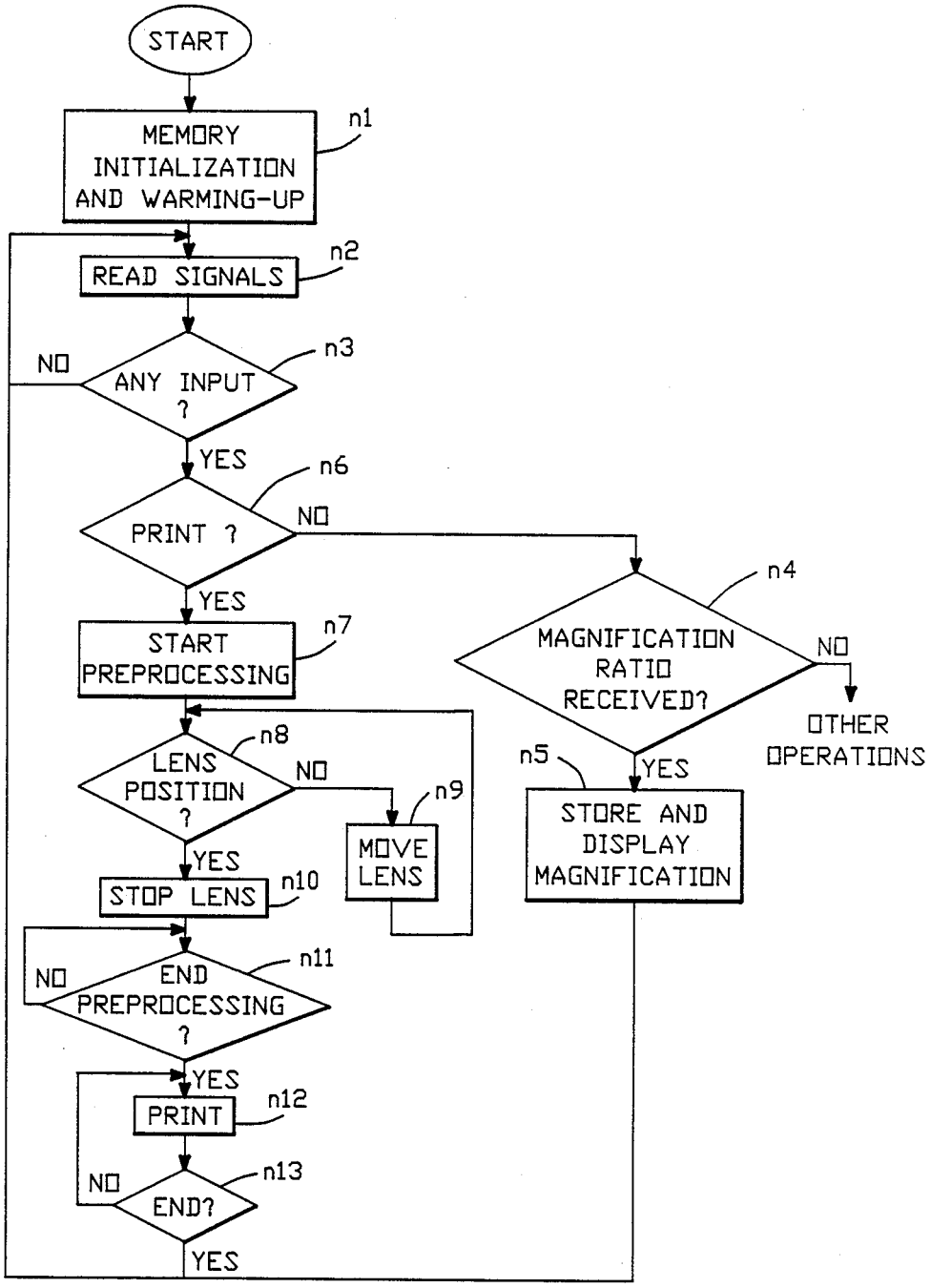
FIG. 3 is a flow chart of the program for the operation of the copier of FIGS. 1 and 2.

The operation of the copier is explained next with reference to the flow chart of FIG. 3. After power is switched on, the memory devices are initialized and the developing device 22, the fixing rollers 29, etc. are warmed up (n1). When the warming-up processes are completed, signals from the input keys and sensors are received (n2). If any instruction is inputted (YES in n3), operations take place in response to such an instruction. If a desired magnification ratio is inputted before the print switch is pressed (NO in n6 and YES in n4), the inputted magnification ratio is stored in the memory area M and its value is displayed by the magnification display 44*d* (n5). A desired magnification ratio is inputted by operating the magnification key 44*a* and the inputted magnification ratio is kept in the memory area M until another magnification ratio is inputted. In other words, if it is desired to make many copies successively at the same magnification, the user need not input the magnification ratio each time.

When it is determined that the print switch 44*c* has been operated (YES in n6), preprocessing operations are started (n7) such as starting to rotate the photosensitive drum 2 and uniformly charging it with the primary charger 21 under the control of the process control section 47. The lens 35 is moved (n9), if it is then not at the right position in view of the inputted magnification ratio (NO in n8), until it reaches the right position (n10). When the preprocessing operations are all completed (YES in n11), a copying operation is started (n12-n13). In summary, the lens 35 is moved only after the print switch 44*c* is operated to start a copying operation according to the present invention such that the lens 35 is moved to its desired position according to the inputted magnification ratio. As a result, the lens 35 is prevented from moving uselessly.

The foregoing description of a preferred embodiment of the invention has been presented for purposes of illustration and description. It is not intended to be exhaustive or to limit the invention to the precise form disclosed. Many modifications and variations are possible in light of the above teaching. For example, although an example was shown above whereby a key-inputted magnification ratio is stored in the memory area M, the magnification ratio may be stored in different manners. The ratio to be stored may be calculated from the size of the original document to be copied and that of the image receiving sheet. A default magnification ratio (usually 100%) may be preselected such that this value is automatically set if a predetermined length of time (usually a few minutes) passes without any key input. The present invention teaches that in such situations, too, the lens 35 be moved according to the selected magnification ratio only after the print key is operated to start a copying operation. Moreover, although an optical system with a zoom lens was disclosed above, use may equally well be made of an optical system adapted to change its magnification ratio by moving both a lens and a mirror or mirrors. Any such modifications and variations that may be apparent to a person skilled in the art are intended to be included within the scope of this invention.

What is claimed is:

1. A copier capable of varying magnification ratio comprising input means for receiving a magnification ratio, lens moving means for moving an optical system of said copier according to said received magnification ratio, and control means for driving said lens moving means only after a print switch is operated to start a copying operation of said copier to move said optical system to a position determined by said received magnification ratio.

2. The copier of claim further comprising a memory means for storing said received magnification ratio.

3. The copier of claim 1 further comprising display means for displaying said received magnification ratio.

* * * * *